US007246995B2

(12) United States Patent
Zborovsky

(10) Patent No.: US 7,246,995 B2
(45) Date of Patent: Jul. 24, 2007

(54) SEAL USABLE BETWEEN A TRANSITION AND A TURBINE VANE ASSEMBLY IN A TURBINE ENGINE

(75) Inventor: James Michael Zborovsky, Orlando, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 251 days.

(21) Appl. No.: 11/008,898

(22) Filed: Dec. 10, 2004

(65) Prior Publication Data

US 2006/0127219 A1 Jun. 15, 2006

(51) Int. Cl.
*F01D 25/26* (2006.01)

(52) U.S. Cl. ..... 415/137; 415/209.3

(58) Field of Classification Search ..... 415/222, 415/135, 137, 138, 209.3; 60/799
See application file for complete search history.

(56) References Cited

U.S. PATENT DOCUMENTS

| | | | | |
|---|---|---|---|---|
| 3,750,398 | A | 8/1973 | Adelizzi et al. | |
| 3,759,038 | A | 9/1973 | Scalzo et al. | |
| 4,527,397 | A | 7/1985 | Tobery et al. | |
| 4,813,608 | A * | 3/1989 | Holowach et al. | 239/265.37 |
| 5,127,229 | A | 7/1992 | Ishibashi et al. | |
| 5,400,586 | A | 3/1995 | Bagepalli et al. | |
| 5,749,218 | A * | 5/1998 | Cromer et al. | 60/796 |
| 5,964,091 | A | 10/1999 | Fukui et al. | |
| 6,334,310 | B1 | 1/2002 | Sutcu et al. | |
| 6,347,508 | B1 * | 2/2002 | Smallwood et al. | 60/796 |
| 6,450,762 | B1 | 9/2002 | Munshi | |
| 6,547,257 | B2 | 4/2003 | Cromer | |
| 6,792,763 | B2 * | 9/2004 | Sileo et al. | 60/796 |
| 2004/0112039 | A1 | 6/2004 | Koganezawa et al. | |

FOREIGN PATENT DOCUMENTS

| | | | |
|---|---|---|---|
| JP | 54027611 | A | 3/1979 |
| JP | 58208519 | A | 12/1983 |
| JP | 02095733 | A | 4/1990 |
| JP | 08285284 | A | 11/1996 |
| JP | 11082062 | A | 3/1999 |

* cited by examiner

*Primary Examiner*—Edward K. Look
*Assistant Examiner*—Devin Hanan

(57) ABSTRACT

A seal usable to seal a transition in a can-annular combustion system of a turbine engine to a turbine vane assembly to direct exhaust gases through the turbine vane assembly. The seal may be formed from an elongated body extending along an outer edge of the transition and having first and second edges. The first edge of the seal may be attached to the transition, and the elongated body may extend away from the transition edge and contact a portion of the turbine vane assembly. The elongated body may flex during use without yielding or otherwise deforming.

19 Claims, 3 Drawing Sheets

SEAL USABLE BETWEEN A TRANSITION AND A TURBINE VANE ASSEMBLY IN A TURBINE ENGINE

FIELD OF THE INVENTION

This invention is directed generally to transitions in turbine engines between combustors and turbine vane assemblies for directing exhaust gases into the turbine vane assemblies and, more particularly, to devices that function as seals between transitions and turbine vane assemblies.

BACKGROUND

Turbine engines typically combust a mixture of fuel and air in a combustion chamber and pass the exhaust gases produced in the combustion chamber through a turbine vane assembly to drive the turbine assembly. Typically, a plurality of transitions couple a combustor to a turbine vane assembly in a can-annular system. During operation of a turbine engine, exhaust gases flow through the transitions and into the turbine vane assemblies. Seals couple the transitions to the turbine vane assemblies to prevent an undesirable air mixture, such as to prevent an excess amount of air from mixing with the combustion gases. The seals prevent gases from outside the transition to enter and mix combustion gas flow. Conventional seals are often manufactured from rigid materials that are unable to absorb movement and vibrations, thereby resulting in fatigue and premature failure. Thus, a need exists for a seal configured to couple a transition to a turbine vane assembly and be capable of absorbing movement by the components while being exposed to a high temperature environment.

SUMMARY OF THE INVENTION

This invention relates to a seal located between a transition in a can-annular combustion system of a turbine engine and a turbine vane assembly to direct exhaust gases through the turbine vane assembly. The seal may be formed from an elongated body extending along an outer edge of the transition. The elongated body may include a first edge attached to the transition and a second edge that extends toward the turbine vane section. The elongated body may extend away from the transition and contact a portion of the turbine vane assembly enabling a seal to be formed and the elongated body to flex when the turbine engine is operating.

The seal may include a support device or movement limiting device coupled to the transition and positioned between the elongated body and the transition for limiting bending of the elongated body toward the transition. The elongated body may be preloaded such that the seal is placed under a load by flexing the elongated body when the elongated body is placed in contact with the turbine vane assembly. In this position, the elongated body is able to maintain contact with the turbine vane assembly before turbine engine operation and while the components are moving due to thermal expansion and vibration during typical engine operation.

The seal may also include a secondary clip attached to the turbine vane assembly such that a portion of the elongated body attached to the transition bears against the secondary clip to form a seal between the transition and the turbine vane assembly. The secondary clip may include a wear reduction surface, which may be, but is not limited to being, felt metal, at a location where the elongated body contacts the secondary clip. The secondary clip may include a fixating device, such as a catch, for preventing the secondary clip from separating from the turbine vane assembly.

An advantage of this invention is that the elongated body forming the seal is, capable of flexing during operation of a turbine engine while maintaining full contact a at the sealing interface, thereby preventing unpredictable emission debits due to excessive leakage.

Another advantage of this invention is that the seal may be easily removed and replaced at the required service interval. The formed seal presented herein provides an inexpensive alternative to the less compliant cast seal designs used within earlier gas turbine sealing applications.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
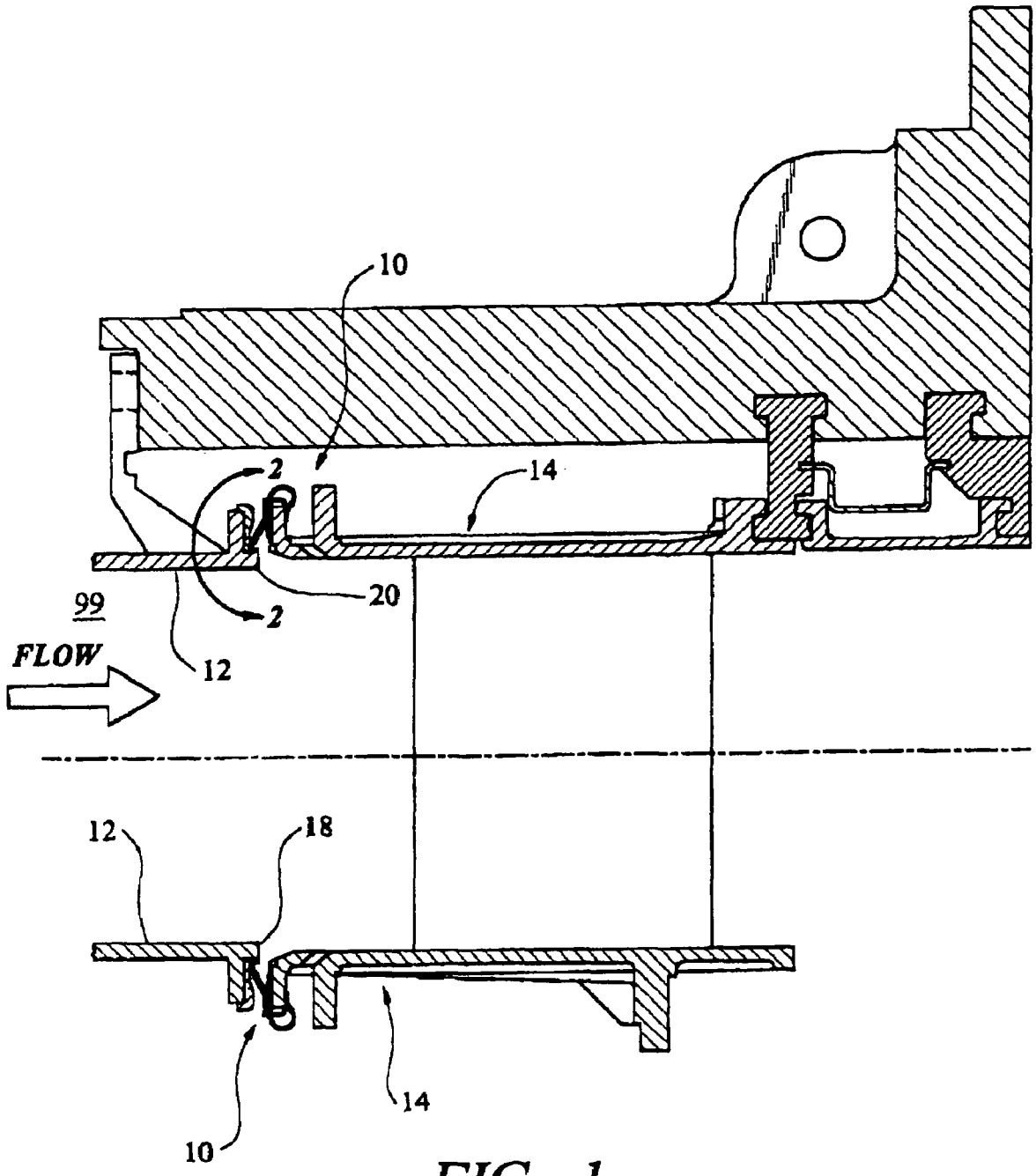
FIG. 1 is a longitudinal cross-sectional view of an intersection between a transition and a turbine vane assembly in a turbine engine and includes a seal having aspects of this invention.
Figure 2:
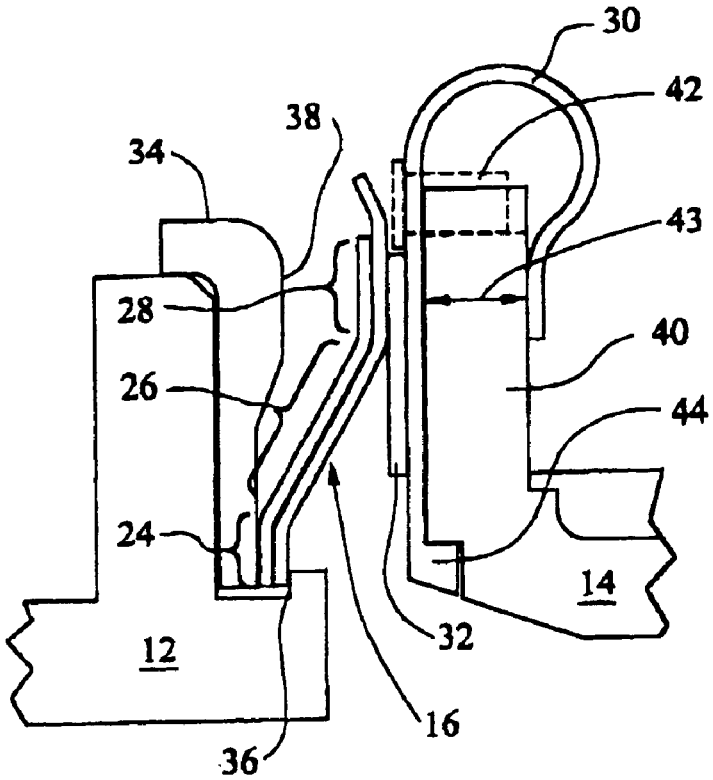
FIG. 2 is a detail view of the seal shown in FIG. 1 at detail 2.
Figure 3:
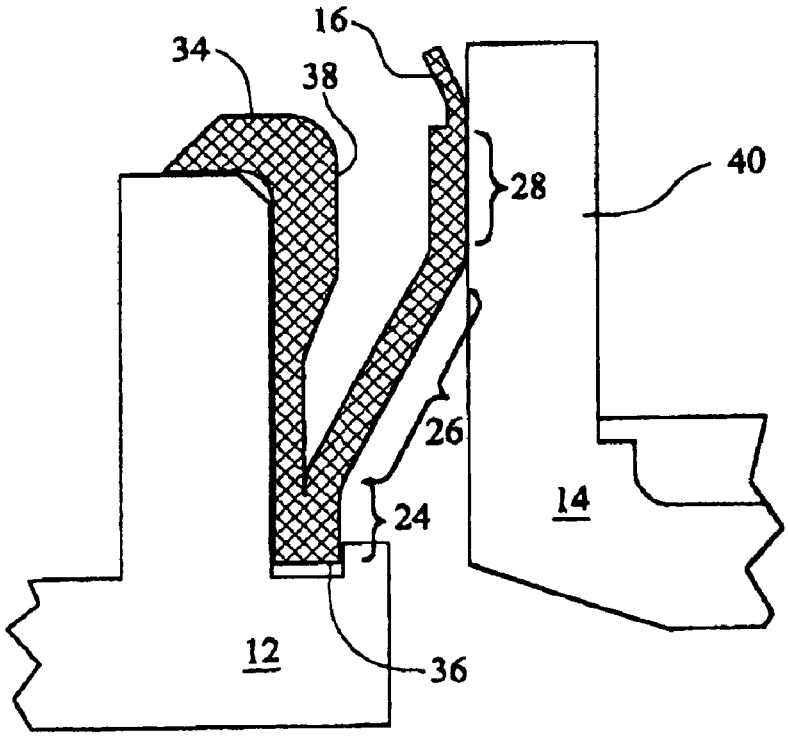
FIG. 3 is an alternative seal of this invention without the secondary clip.
Figure 4:
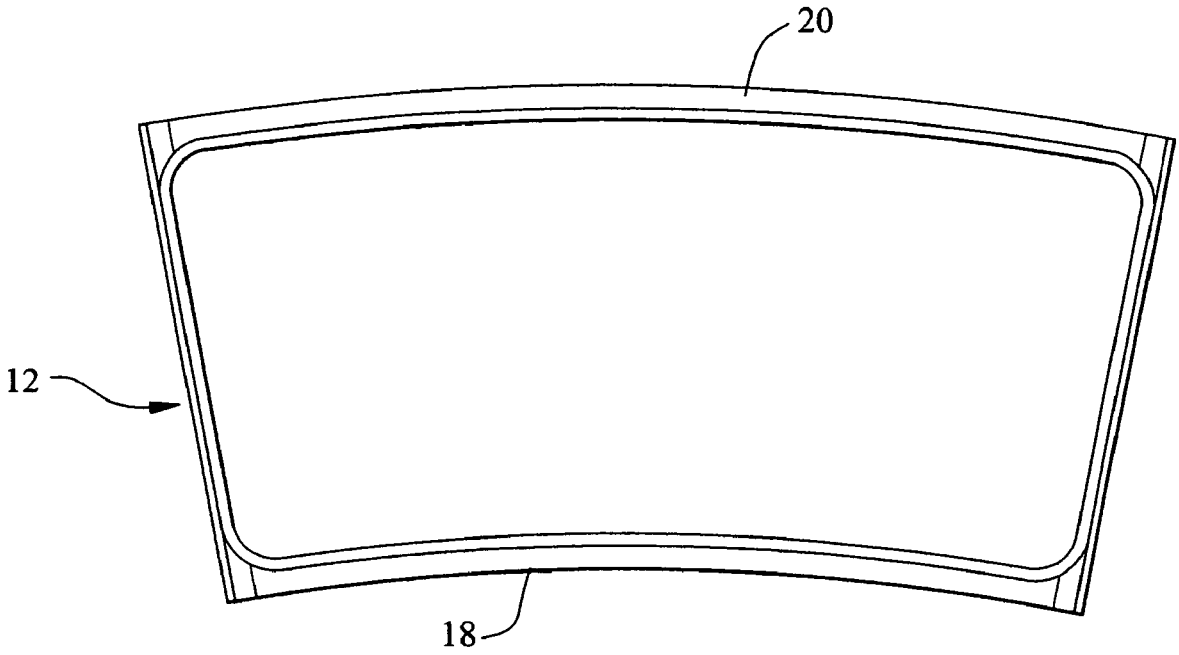
FIG. 4 is front view of a transition.
Figure 5:
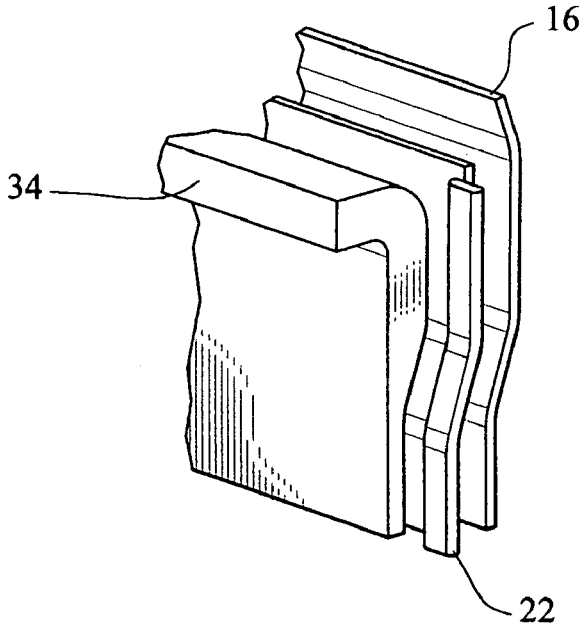
FIG. 5 is an exploded partial perspective view of a seal according to this invention.

As shown in FIGS. 1–5, this invention is directed to a seal 10 for sealing a transition 12 in a can-annular combustion system of a turbine engine to a turbine vane assembly 14 to prevent or substantially limit leakage of gases into the flow path 99. The seal 10 is formed from an elongated body 16 extending the width of a transition 12, as shown in FIG. 4. The seal also extends from the transition 12 and contacts the turbine vane assembly 14, as shown in FIG. 2. The seal 10 may be coupled to a inner edge 18 of the transition 12 and to an outer edge 20 of the transition. At least one can-annular turbine engine may be formed from sixteen transitions 12 spaced radially around a longitudinal axis. The transitions 12 are typically positioned immediately adjacent each other and form a ring around a longitudinal axis of the turbine engine. The transitions 12 may be sealed to the turbine vane assembly 14 using seals 10. The seals 10 may be coupled together using offset lips 22, as shown in FIG. 5, to further limit secondary flow losses between seal segments. The seals may be used with turbine engines that have other numbers of transitions 12.

The seal 10 may be formed from an elongated body 16 extending along the inner or outer edge 18, 20 of the transition 12. The elongated body 16 may be formed from one or more sheets and preloaded to contact a turbine vane assembly 14 when installed within the engine. For instance, as shown in FIG. 2, the elongated body 16 may be formed from two elongated bodies 16. The elongated body 16 may be formed from a transition attachment section 24, an angled extension section 26, and a turbine vane assembly sealing section 28, as shown in FIGS. 2 and 3. The transition attachment section 24 may be configured to be attached to a inner or outer edge 18, 20 of the transition 12. The angled extension section 26 extends away from the transition attachment section 24 so that the turbine vane assembly sealing section 28 contacts a turbine vane assembly 14. The angled extension section 26 also extends from the transition 12 at an angle other than orthogonal, thereby enabling the elongated body to flex when a load is applied to the elongated body 16 when the distance between the transition 12 and the turbine vane assembly 14 is reduced. In at least one embodiment, the transition attachment section 24 may be generally parallel with the turbine vane assembly sealing section 28. The elongated body 16 may be formed from a temperature resistant material, such as, but not limited to, a nickel-chromium alloy, such as X-750. The multiple formed segments (multi-ply) of the seal design can be joined by, but not limited to, welding or fasteners at region 28.

The seal 10 may also include a secondary clip 30 to reduce wear on the elongated body 16. The secondary clip 30 maybe attached to a rib 40 extending from the turbine vane assembly 14. The secondary clip 30 may also include a fixating device 44, which may be, but is not limited to, a catch for preventing the secondary clip 30 from becoming dislodged from its position on the rib 40. The secondary clip 30 may be sized such that an opening 43 in the clip 30 is slightly smaller than a thickness of the rib 40, which results in an applied clamping force Circumferential movement of the secondary clip may be prevented by introducing a mechanical stop with a mechanical connector, such as, but not limited to, a pin 42. The secondary clip 30 may include a wear reduction surface 32 at a location where the elongated body 16 contacts the secondary clip 30. The wear reduction surface 32 may be formed from a separate member that may be replaceable or may be an integral component of the secondary clip 30. The wear reduction surface 32 may also be positioned on the formed seal region 28 in an alternative embodiment. The wear reduction surface 32 may be manufactured from a material with a lesser density than solid base metal, such as felt metal. Surface 32 may be manufactured from felt metal material, formed from felt metal, such as, but not limited to, HAYNES-188, which is a cobalt-nickel-chromium-tungsten alloy that combines excellent high-temperature strength with very good resistance to oxidizing environments up to 2000° F., FeCrAlY, fiber metal, advanced coatings, or other appropriate materials. The wear reduction surface 32 may also include coatings to reduce friction, thereby limiting wear and increasing the life of the elongated body 16. The secondary clip 30 may be formed from a temperature resistant material, such as, but not limited to, a nickel-chromium alloy, such as X-750.

The seal 10 may also include a support device or movement limiting device 34 coupled to the transition 12 and positioned between the elongated body 16 and the transition 12 for limiting compression of the elongated body 16 toward the transition 12. The support device 34 may be positioned such that the elongated body 16 may bend relative to the point of attachment 36 to compensate for movement during normal operation of the turbine engine. However, the support device 34 is positioned relative to the turbine vane assembly 14 such that the elongated body 16 may bend but not yield and lose its original shape by maintaining material resiliency. Initially, the angled extension section 26 of the elongated body 16 is formed such that when the transition attachment section 24 is attached to the support device 34, the elongated body 16 is placed under a load as the elongated is flexed and contacts the turbine vane assembly 14. The support device 34 includes a protrusion 38 that extends from the support device 34 and prevents the elongated body 16 from yielding in a permanently bent position different from an original position. The support device 34 may be contoured as shown in FIGS. 2 and 3 to conform to the shape of the elongated body 16. The support device 34 may be formed from a temperature resistant material, such as, but not limited to, a nickel-chromium alloy, such as INCONEL-625.

During operation of a turbine engine to which the seal is attached, thermal expansion and vibrations cause the elongated body 16 of the seal 10 to flex while enabling the turbine vane assembly sealing section 28 of the elongated body 16 to remain in contact with the turbine vane assembly 14. The seal 10 may also limit leakage between adjacent seals 10 through use of the offset lip 22 on the end of the seal 10 that engages with an adjacent seal 10. The offset lip 22 allows adjacent seals 10 to move axially and radially during operation of the turbine engine without detrimentally effecting the seal 10.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A seal usable to seal a transition in a can-annular combustion system of a turbine engine to a turbine vane assembly, comprising:

an elongated body extending along an edge of the transition and attached to the transition, wherein the elongated body includes a first edge attached to the transition and a second edge in contact with the turbine vane assembly, and a secondary clip attached to the turbine vane assembly such that a portion of the elongated body bears against the secondary clip to form a seal between the transition and the turbine vane assembly, wherein the elongated body extends away from the transition and contacts a portion of the turbine vane assembly enabling a seal to be formed and the elongated body to flex when the turbine engine is operating.

2. The seal of claim 1, wherein the elongated body is comprised of first and second sheets coupled together.

3. The seal of claim 1, wherein the elongated body is formed from a transition attachment section adapted to be coupled to the transition, an angled extension section extending between the transition and the turbine vane assembly, and a turbine vane assembly sealing section for contacting the turbine vane assembly.

4. The seal of claim 1, further comprising a support device coupled to the transition and positioned between the elongated body and the transition for limiting bending of the elongated body toward the transition.

5. The seal of claim 4, wherein the support device comprises a protrusion extending from the support device that corresponds with the elongated body so that the elongated body is supported by the support device when the elongated body is deflected.

6. The seal of claim 1, wherein the elongated body is coupled to inner and to outer edges of the transition.

7. The seal of claim 1, wherein the secondary clip further comprises a fixating device for preventing the secondary clip from separating from a rib on the turbine vane assembly.

8. The seal of claim 1, wherein the secondary clip further comprises a wear reduction surface at a location where the elongated body contacts the secondary clip.

9. The seal of claim 8, wherein the wear reduction surface comprises felt metal.

10. The seal of claim 1, wherein the secondary clip is prevented from circumferential movement using at least one pin.

11. The seal of claim 1, wherein the elongated body includes an offset lip at a side edge of the elongated body for sealing the elongated body to an adjacent transition seal.

12. A seal usable to seal a transition in a can-annular combustion system of a turbine engine to a turbine vane assembly, comprising:

an elongated body extending along an edge of the transition and attached to the transition, wherein the elongated body includes a first edge attached to the transition and a second edge in contact with the turbine vane assembly, and wherein the elongated body extends away from the transition and contacts a portion of the turbine vane assembly enabling a seal to be formed and the elongated body to flex when the turbine engine is operating;

a support device coupled to the transition and positioned between the elongated body and the transition for limiting bending of the elongated body toward the transition; and a secondary clip attached to the turbine seal assembly such that a portion of the elongated body bears against the secondary clip to form a seal between the transition and the turbine vane assembly.

13. The seal of claim 12, wherein the elongated body is comprised of first and second sheets coupled together.

14. The seal of claim 12, wherein the elongated body is formed from a transition attachment section adapted to be coupled to the transition, an angled extension section extending between the transition and the turbine vane assembly, and a turbine vane assembly sealing section for contacting the turbine vane assembly.

15. The seal of claim 12, wherein the support device comprises a protrusion extending from the support device that corresponds with the elongated body so that the elongated body is supported by the support device when the elongated body is deflected.

16. The seal of claim 12, wherein the secondary clip further comprises a fixating device for preventing the secondary clip from separating from a rib on the turbine vane assembly.

17. The seal of claim 12, wherein the secondary clip further comprises a wear reduction surface at a location where the elongated body contacts the secondary clip.

18. The seal of claim 17, wherein the wear reduction surface comprises felt metal.

19. The seal of claim 12, wherein the elongated body includes an offset lip at a side edge of the elongated body for sealing the elongated body to an adjacent transition seal.

* * * * *